US007709715B2

(12) United States Patent
Stevens et al.

(10) Patent No.: US 7,709,715 B2
(45) Date of Patent: May 4, 2010

(54) KEYBOARD PERCUSSION INSTRUMENT INCLUDING IMPROVED TONE BAR RESONATOR

(75) Inventors: Leigh Howard Stevens, Elberon, NJ (US); Robert W. L. Barkovitz, Wayne, NJ (US)

(73) Assignee: Malletech L.L.C., Asbury Park, NJ (US)

( * ) Notice: Subject to any disclaimer, the term of this patent is extended or adjusted under 35 U.S.C. 154(b) by 363 days.

(21) Appl. No.: 11/557,613

(22) Filed: Nov. 8, 2006

(65) Prior Publication Data

US 2008/0105105 A1 May 8, 2008

(51) Int. Cl.
*G10D 13/08* (2006.01)

(52) U.S. Cl. ..... 84/402

(58) Field of Classification Search ..... 84/402–410
See application file for complete search history.

(56) References Cited

U.S. PATENT DOCUMENTS 1,807,057 A * 5/1931 Bowers ..... 84/403
2,556,342 A * 6/1951 Dickran ..... 84/409
2,795,162 A * 6/1957 Eash ..... 84/397
3,649,737 A 3/1972 Jespersen
3,858,477 A 1/1975 Kawakami
4,570,525 A 2/1986 Suzuki
4,941,386 A 7/1990 Stevens
5,189,236 A 2/1993 Stevens

OTHER PUBLICATIONS

"Malletech Instruments", *Brochure*, (Dec. 2000), pp. 3-4.
Yamaha, "Concert Series Marimbas", *Advertisement*, (Dec. 2005), pp. 1.
"Adams Marimbas & Xylophones", *Brochure*, (Jan. 1996), pp. 1.

* cited by examiner

*Primary Examiner*—Kimberly R Lockett
(74) *Attorney, Agent, or Firm*—Grossman Tucker Perreault & Pfleger, PLLC

(57) ABSTRACT

An improved resonator for keyboard percussion instruments such as marimba, vibraphone and xylophone and instruments including such resonators are described herein. In one or more embodiments, a tubular resonator bent or formed into a smooth curve, open or stopped on one end, resonating only its natural fundamental frequency and its natural overtones with no non-harmonic resonances from a struck tone bar associated with the resonator is provided. According to one or more embodiments, the number of joints in the resonator is reduced to less than two joints.

23 Claims, 9 Drawing Sheets

KEYBOARD PERCUSSION INSTRUMENT INCLUDING IMPROVED TONE BAR RESONATOR

BACKGROUND

Embodiments of the present invention generally relate to "keyboard percussion instruments", such as marimbas, vibraphones and xylophones, which have resonators in proximity to tone bars. Specific embodiments pertain to improved resonators and instruments incorporating improved resonators.

The genre of keyboard percussion instruments is also known as "bar percussion instruments" or "tuned mallet instruments". With the exception of the glockenspiel ("orchestra bells"), which traditionally have their bars made of steel, the tone bars of the keyboard percussion instrument family generally do not produce sufficient volume for musical performance, without amplifying the acoustic output of the tone bar with a similarly tuned resonator in proximity to the tone bar.

In the field of keyboard percussion instruments such as marimbas, vibraphones, xylophones and glockenspiels, many different sizes, shapes and methods of amplifying the tone bars have been developed. Going back into the early part of the last century, Deagan, and Liebich experimented with resonator designs. These inventions mainly concern small high-pitched instruments where the resonator needed to fit directly under the tone bar and in the same parallel plane. U.S. Pat. No. 3,858,477 issued to Kawakami discusses two-part rectangular boxes extending beneath the tone bars and then turning at right angles. The purpose of such an arrangement is said to save space and allow an instrument to be of "small height".

U.S. Pat. Nos. 4,570,525; 4,941,386 and 5,189,236 pertain to the fine tuning adjustment of the fundamental pitch of tubular resonators. While all three methods have been used successfully in the real world to adjust for temperature and humidity conditions (which change the frequency of both the bars and tubes, but in opposite directions), they do not address the more basic shortcomings of the shape and construction of the resonator itself. U.S. Pat. No. 3,649,737 issued to Jespersen dispenses with the resonators entirely, preferring a pickup coil, amplifier and speaker arrangement. While this might be a viable solution for amplified music styles such as jazz and popular music, players of keyboard percussion instruments more often play music of a type where it is inappropriate to amplify the sound.

It should be noted that all musical instrument manufacturers of keyboard percussion instruments currently use tubes that are stopped at one end—which already shortens the required length of the resonator by half—so no further reductions in length are obtainable. The only other methods are to be found by increasing the volume in other dimensions or by curving the tubes back up before they reach the floor. It is well known that it is more difficult to produce good musical results from the low notes than from the mid and high ranges. While the mid and high ranges of keyboard percussion instruments have traditionally been provided with straight tubular resonators, as the range expanded into lower notes, there is not sufficient room between the tone bar and floor to fit the required straight length of tubing. For instance, the lowest resonator on a 5-octave marimba that can be fit under a standard height keyboard is the "A" below middle "C" which is approximately 31 inches in length. Below this musical range, the designer must find another way to acoustically resonate the tone bar in the space available.

Another factor limiting the possible solutions is the size and spacing of the tone bars. Bass register tone bars must be of sufficient width to produce enough power to couple properly with the associated resonator. Generally speaking, a wider tone bar "moves more air". All other things being equal, a wider tone bar design will produce more usable volume out of the resonator. However, the associated resonator beneath the bar cannot be too large in diameter or width (depending on whether the resonator is round, square or rectangular at the opening beneath the bar—all of which are currently used by today's musical instrument manufacturers), or the bar will not be able to set the volume of air into vibration except by a very heavy stroke of the mallet. On the other hand, if the resonator is too narrow in diameter or width, the resonator will be set into sympathetic vibration more easily, but the resulting tone will be of weak volume and unsatisfactory in a concert hall.

Yet another factor is the intervallic reach of the player's mallets. For many years, keyboard percussion instruments have been played by musicians holding four mallets—two in each hand (two and six mallet repertoire being less common and therefore not as relevant to design considerations). The larger the width of the bar and resonator combination, the "bigger" the sound, but the more difficult it is for the player to span the distance between two notes played in one hand. It is generally accepted by those skilled in the art of designing keyboard percussion instruments that the size of the lowest octave must be of a distance that can be spanned by the two mallets in the player's left hand.

Two of the biggest percussion instrument companies in the field (Yamaha Corporation and the European company Adams), as well as some smaller firms, use a resonator shape that they refer to as a "Helmholtz Resonator" (after Herman L. F. von Helmholtz, 1821-1894 who first described a similar type of resonator and was the author of *On the Sensations of Tone*, published in 1862). This shape was originally introduced by a small Japanese company named Korogi in the 1980's. These resonators are generally made of sheet metal rather than round tubing and are rectangular at the opening near the tone bar, flat-sided, and sometimes even flaring into a three-dimensional trapezoidal shape at the closed bottom. FIG. 1 shows an example of this type of resonator.

The original Helmholz resonator was a sphere with a hole or neck and was intended to pick out and resonate a single frequency from a more complex sound. Such a design would be unsatisfactory for amplifying tone bars of keyboard percussion instruments because of the limited volume potential. Instead of selecting a single frequency like the original Helmholtz resonator, instrument designers have adopted the idea to keyboard percussion by using rectangular tubing connecting to sloping sides, continuing to refer to these new and varied shapes as "Helmholtz Resonators", as shown in FIG. 1. These irregular shapes dramatically increase the complexity of the harmonic content of the resonator from one frequency to almost infinite harmonics. Unlike the original sphere with a hole in it, these irregular shapes "reduce the selectivity" of the frequencies they resonate and somewhat widen the range of the fundamental pitches that can be obtained. When an air stream is forced across the open face a huge array of harmonics is heard—something more like a noise than a musical tone. However, when a tone bar is set in motion with a mallet above, the fundamental frequency of the bar does find a mode to vibrate, along with many other frequencies contained in the tone bar.

Another design rich in harmonics is offered by the American manufacturer "Marimba One". In this design, a teardrop/elliptical shape is chosen instead of a more harmonically neutral round tube. Because of the lack of a focused fundamental frequency in such a shape, the manufacturer adds something like an organ builder's "Haskill" pipe inside the teardrop shape. This pipe within a pipe helps to clarify the vast array of harmonics into a more responsive order and adds to the effective length of the tube. FIG. 2 shows such a design.

Like in the "Helmholtz" resonators above, when an air stream is forced across the open face a huge array of harmonics is heard—again, something more like a noise than a musical tone. However, when a tone bar is set in motion with a mallet above, the fundamental frequency does find a mode to vibrate, along with many other frequencies contained in the tone bar.

There are also round tubular solutions available from Steinway's Musser Marimba division, Yamaha and Malletech, for example. In each of these solutions, 22.5° angled sections of round tubing are welded, brazed or soldered together. These designs have 4 welded joints connecting the 5 sections of tubing. FIGS. 3A-3C show examples of such configurations. FIG. 3A shows a substantially J-shaped first octave C resonator 10 for a keyboard percussion instrument. FIG. 3B shows a substantially U-shaped first octave C sharp resonator 20 for a keyboard percussion instrument. FIG. 3C shows a substantially L-shaped first octave F-sharp resonator 30 for a keyboard percussion instrument. As will be seen from a review of FIGS. 3A-3C, each of these resonators includes a number of joined sections. The L-shaped resonator 30 shown in FIG. 3C comprises three sections 32, 34, and 36 joined together and has two joints 33 and 35, whereas, the U-shaped resonator 20 in FIG. 3B comprises five sections 22, 24, 26, 28, and 39 and four joints 21, 23, 25 and 27. In FIG. 3A, the J-shaped resonator also comprises five sections 12, 14, 16, 18, 19 and four joints 11, 13, 15 and 17. As noted above, each of the sections are joined at 22.5° angles with respect to each other.

Established thinking in the field assumes that a 5-section design offers the best of 2 worlds: it adheres to the basics tenets of fluid dynamics that promise easier flow through a gentle bend, while offering many internal facets at the joints that can reinforce the resonance and enrich the harmonic content of the resultant tone. When a stream of air is blown across the open face of this type of resonator, a clear fundamental pitch is heard, along with both harmonic and non-harmonic components.

While these various resonator designs have provided acceptable sound, as will be appreciated upon further reading of the details of the present invention, it would be desirable to provide a resonator that reduces or eliminates non-harmonic components. It would be desirable to provide improved resonators for keyboard percussion instruments that do not suffer from one or more of these disadvantages.

SUMMARY OF THE INVENTION

One embodiment of the present invention relates to keyboard percussion instruments having resonators in proximity to tone bars. Other embodiments relate to improved resonators for keyboard percussion instruments.

In accordance with one embodiment of the present invention, a keyboard percussion musical instrument is provided which comprises a plurality of tone bars and resonators in proximity to the tone bars, at least one of the resonators comprising a curved, substantially continuous conduit including two or less sections. According to one or more embodiments, the resonator is curved to substantially resemble a J-shape or U-shape. In certain embodiments, the resonator tube includes only one joint.

In other embodiments, the resonator comprises a single, unitary section with no joints. For example, in one embodiment, the resonator is curved to substantially resemble an L-shape and comprises a single, unitary section with no joints. According to one or more embodiments, the resonator is substantially tubular and defines a tube radius, and the tube is bent about a bend radius, the tube radius and the bend radius being substantially equal. In certain embodiments, the resonator has no internal encumbrances such as welds, solder joints or sharp bends.

According to one or more embodiments, the resonator is stopped on one end. In one or more embodiments, the resonator is open on both ends. In certain embodiments, the resonator is constructed so that it resonates only its natural fundamental frequency and its natural overtones with no non-harmonic resonances from a struck tone bar associated with the resonator.

Another embodiment of the invention, pertains to a keyboard percussion musical instrument comprising a plurality of tone bars and resonators acoustically coupled the tone bars, at least one of the resonators comprising a conduit constructed so that it resonates only its natural fundamental frequency and its natural overtones with no non-harmonic resonances from a struck tone bar associated with the resonator. In one or more embodiments, the internal surface of the conduit is smooth and free from sharp bends, angle and discontinuities. According to certain embodiments, an instrument is provided wherein at least one of the resonators comprises an inverted U-shaped conduit having two downwardly facing open ends and an outer curved surface having an opening through the outer curved surface. According to one embodiment, the downwardly open ends are plugged and the opening is substantially circular. The foregoing has outlined rather broadly certain features and technical advantages of the present invention. It should be appreciated by those skilled in the art that the specific embodiments disclosed may be readily utilized as a basis for modifying or designing other structures or processes within the scope present invention. It should also be realized by those skilled in the art that such equivalent constructions do not depart form the spirit and scope of the invention as set forth in the appended claims.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
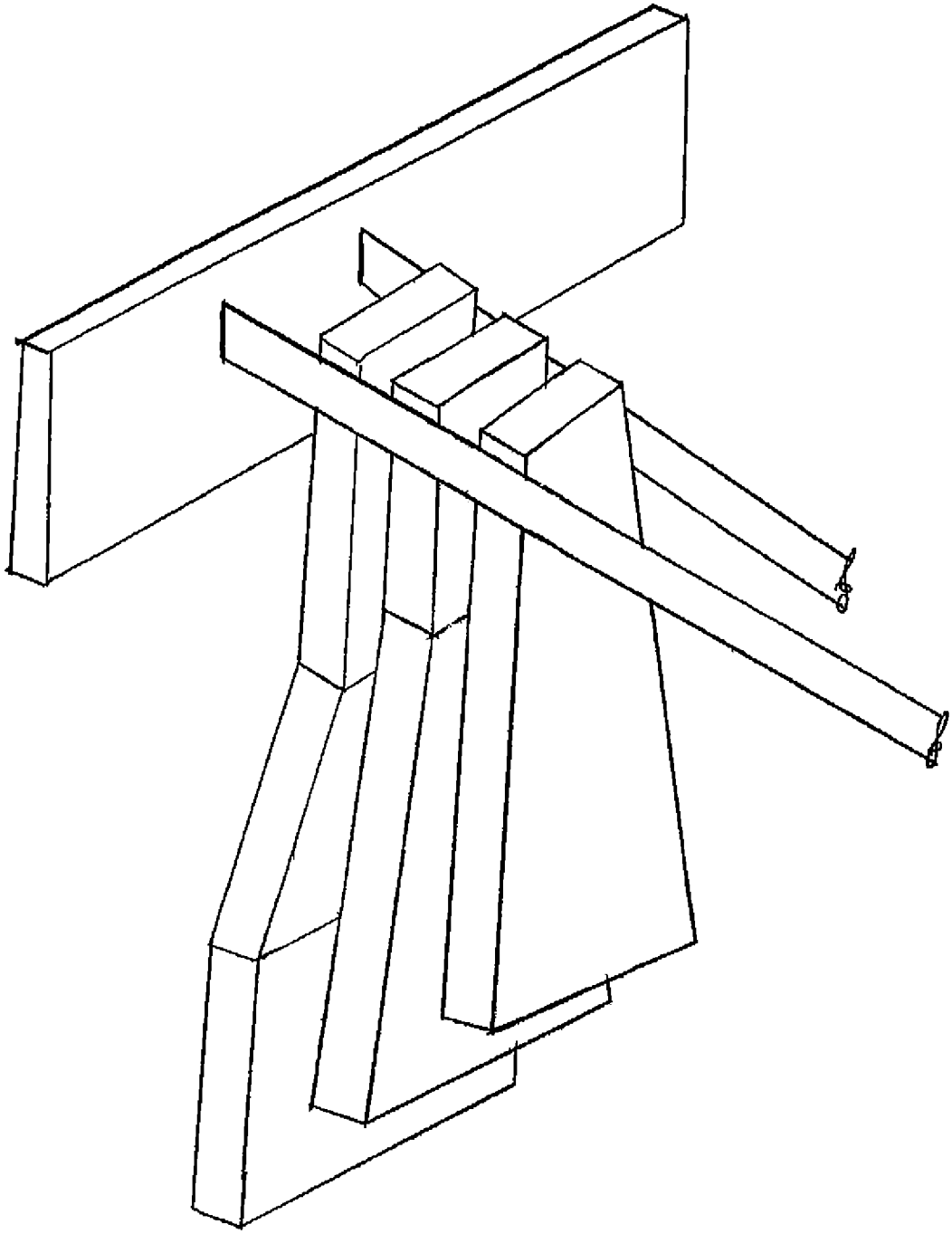
FIGURE 1 (PRIOR ART)
FIG. 1 is a perspective view of a type of prior art resonator.
Figure 2:
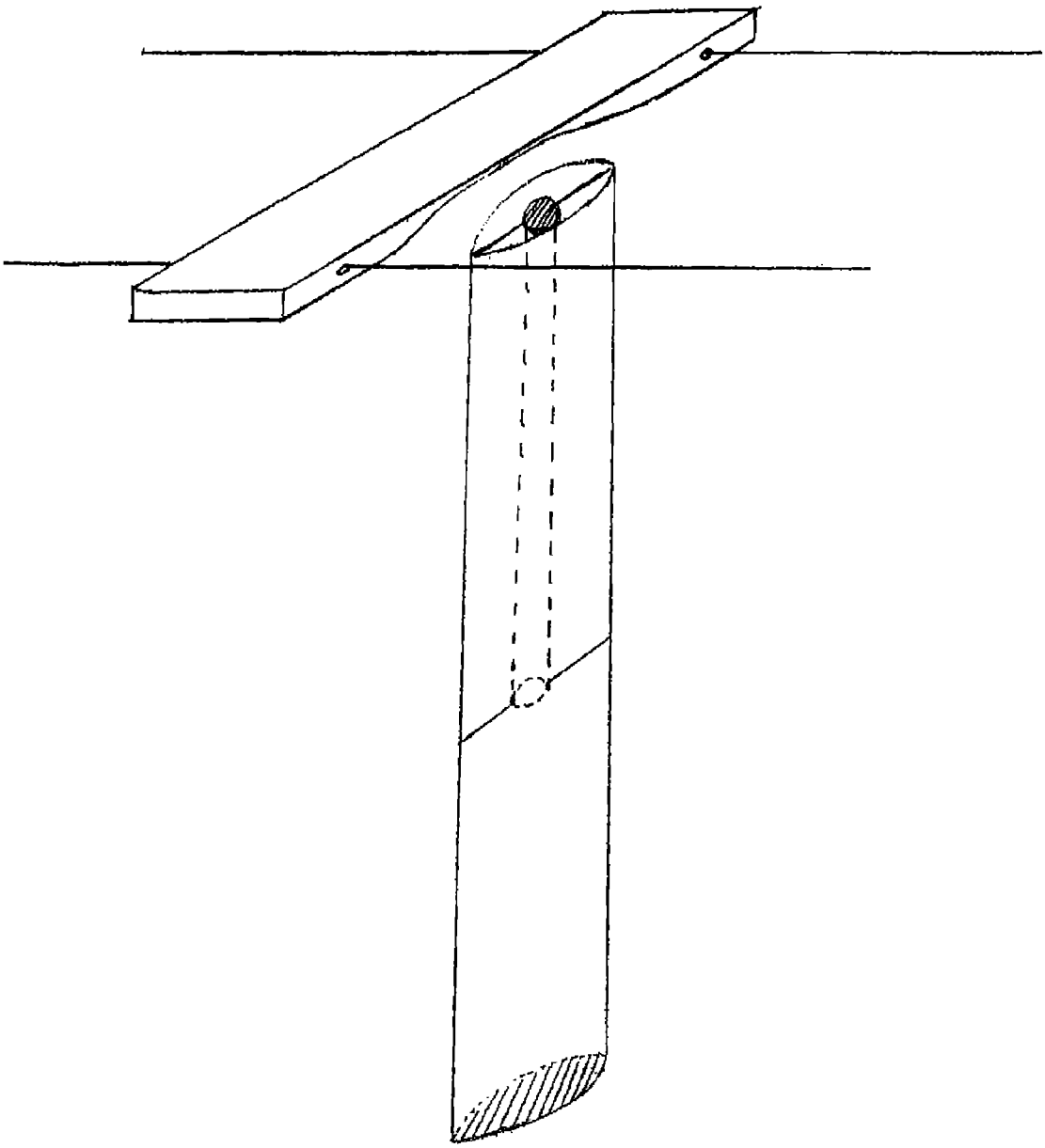
FIGURE 2 (PRIOR ART)
FIG. 2 is a perspective view of another type of prior art resonator.

Embodiments of the invention generally pertain to resonators for keyboard percussion instruments and their acoustic interaction with the bars of such instruments. As used herein, "keyboard percussion instrument", refers to an instrument which has resonators in proximity to struck tone bars. As used herein, "in close proximity" means that the resonator is at a distance to the tone bar so that the resonator is acoustically coupled to the tone bar. The keys or bars, which typically are made of wood, metal, steel, fiberglass or other acceptable materials, are struck with mallets to produce musical tones. Non-limiting examples of keyboard percussion instruments include marimbas, vibraphones, and xylophones.

Thus, according to one or more embodiments, keyboard percussion instruments including a resonator with minimal internal interferences and non-harmonic resonances caused by non-parallel surfaces, internal bracing, angles, solder, brazing or weld joints is provided. In certain embodiments, a resonator tube is provided that includes two or less sections. Embodiments of the present invention provide a resonator that offers the musician a dramatic increase in volume with the same sized tone bar and the elimination of the reinforcement of unwanted inharmonic properties of the associated tone bar. A resonator is a conduit placed in close proximity to the tone bar of the instrument. The conduit may be any suitable cross-sectional shape, such as tubular, cylindrical, teardrop shaped, elliptical, square, rectangular or any other suitable shape to provide amplification of the tone bar.

A goal to be achieved according to embodiments of the invention is to produce a large sound in a small space. As noted above, different manufacturers have solved these size and resonance issues in many different ways, but by sacrificing the tonal purity of resultant sound from the instrument. Applicants have discovered a key element that degrades the tone of the low notes of keyboard percussion instruments that has not been appreciated by designers until now and it has been addressed by embodiments of the current invention.

It is almost axiomatic in the instrument design world that a tone "rich in harmonics" is superior to one that has less harmonic content. Designers of synthesized sound have taken this to extraordinary lengths so that even an inexpensive instrument can have sounds with the complexity of a full symphony orchestra at the touch of a button. This has also been the approach of instrument designers in the keyboard percussion field. Resonator design has followed the rule of "more harmonic content is better". As proof of this, one has only to look at the shapes and manufacturing methods of the low register resonators available today. Manufacturers brag about their tone being "rich in harmonics".

The basic principles of fluid dynamics would suggest that the more gradual the curved shape produced by the addition of more segments and lowering the severity of the angle of the joints, the better the sound. However, the experimental reality does not confirm the theory. While the present invention should not be limited by the theoretical explanation that follows, it appears that the internal friction of additional solder and weld joints inside the tube, more than mitigates any advantage of the gentleness of the bend of the shape. Each joint appears to reduce volume by destructive interference and unwanted reflections. Perhaps more important to the "quality of sound", as shown above, these internal edges reinforce certain non-harmonic qualities of percussion tone bars. The production of non-harmonic components results in a loss of power, clarity and purity of tone and carrying power into a concert hall from the instrument.

The axiom that "more is better" when it comes to harmonic content is undeniably true when it comes to violin tone, resonance from a trumpet bell or the sound of a synthesizer tone through a speaker. These harmonic components are produced by natural subdivisions of a string, an air column or by a synthesizer programmer and so their "in-tune" sweet harmonic content is assured by the physics of nature or by the programming skill of the synthesizer designer.

However, applicants have determined that when dealing with resonated keyboard percussion instruments, there is a previously unappreciated downside to a resonator having many modes of vibration. Keyboard percussion tone bars are generally only tuned to their first three modes of vibration. Each category of instrument (marimba, vibes, xylophone) is tuned to highlight a different series of overtones, which gives that particular type of instrument its characteristic timbre. Further, each manufacturer has proprietary standards for these values, but in all cases, these modes are usually tuned to traditionally acceptable "sweet" musical intervals such as octaves, thirds and perfect fifths—just like the above examples of violin and trumpet tone.

However, unfortunately for the purity and clarity of the tone of tone of keyboard percussion instruments, there are more non-harmonic modes of vibration in the bars than controllable harmonic components. Every keyboard percussion tone bar has several torsion modes of vibration, as well as what are referred to as multiple "side tones" and "end tones". These frequencies are stimulated by any stroke of the mallet and vibrate in both the fundamental mode and subdivided overtones. They almost always clash and conflict with the tuned modes of vibration. Thus, when percussion tone bars are put into vibration with a mallet above any of these resonator systems, they "find" resonances within the chamber to reinforce their modes of vibration. The result of this first problem is that the many non-harmonic notes contained in the resultant sound "cloud the tonal image", conflict with the desirable harmonic resonances and make the resultant sound "out of focus"—more like an un-pitched percussion instrument than a carefully tuned keyboard instrument. Further, since the energy produced by the stroke of the mallet is in each case limited to a finite quantity, every decibel of reinforcement of non-harmonic content reduces the strength of the desirable tuned components in the resultant tone.

A further problem with prior art resonator systems is that their internal bracing, welds, solder joints and other flow obstructions, while producing "desirable" harmonics, also produce destructive interference with the purity and strength of the resonance of the fundamental and tuned harmonics of the tone bar. The abundance of unwanted harmonics, combined with the power wasting interferences of the internal structure cause a notable loss of power, clarity of tone, and carrying power into a concert hall.

It is worth noting that manufacturers have been making these instruments for more than 100 years without correctly concluding that there was a connection between the abundance of non-harmonic content of the of the bars with the loss of power within the resonating system. Put simply, the reduction of harmonics as a design path to better sound is counter-intuitive and so it has not been pursued by keyboard percussion instrument manufacturers.

It also should be noted that all recent advancements of resonator design in the past decade have followed the modified trapezoidal "Helmholtz" model that increases the harmonic content to an almost infinite level. Even the most expensive extended-range instruments have followed the conventional wisdom that assumes that a tone "rich in harmonics" is key to a good musical tone. It has been assumed that a tubular resonator plugged on one end already has a "deficit of harmonics" (stopped tubes only resonate the odd-numbered partials) and that further reduction of harmonic content could only degrade the sound further.

This conventional wisdom about abundance of resonance has been based on assumptions which do not apply to keyboard percussion dual vibrating systems (bar and resonator) where one of the systems has non-harmonic material and the other has the chance of amplifying these non-musical partials. Embodiments of the present invention dramatically increases power, projection, sweetness of tone, clarity of pitch of the resonator through the elimination of resonances.

Without limiting the present invention by any particular theory, the following improvements have been noted in the early embodiments of the invention. It appears that the elimination of unnecessary non-harmonic resonances improves the efficiency of the system to the extent that the volume produced by a given stroke of the mallet almost appears to be artificially amplified compared to other resonator designs. To the experienced ear, this result is startling.

Furthermore, the same efficiency and elimination of conflicting resonance appears to produce longer ring of the bar, an attribute that players consider to be a musical and esthetic advantage. In the past, there was always a trade-off between volume and length—the louder a resonator was, the shorter the ring time. The surprising result of this new design is that both attributes appear to be improved simultaneously.

It is remarkable that the same exact tone bars sound better "in tune" with these new continuously curved tubes than with segmented tubular tubes or with "Modified Helmholtz" resonators. It is theorized that the elimination of the non-harmonic components strengthens the properly tuned harmonics and allows them to be heard "arithmetically locking into each other" in the upper frequencies. Another unexpected benefit is the "clarity" of pitch in the low range and in complex chords. Low register diads, triads and 4-pitch chords in the low range of keyboard percussion instruments have always been "muddy" and frequently sound sour or "out of tune" even if the tone bars are checked and found to be precisely tuned. It is theorized that the non-harmonic partials of these low register bars are resonated and reinforced by the old art resonator designs. Because of the low fundamental pitch of these notes, the harmonics are also lower in register and ring long enough to create actual clashes and beats against each other. The continuously curved tubes appear to have no reinforcing effect on these non-harmonic tones. Further, in the current embodiment, the plugged tubes already cancels half of the overtones, further eliminating the possibility of a non-harmonic overtone finding resonance in the tube.

It has also been observed that according to embodiments of the invention, the inherent character of the various materials used for the resonator can be more audibly differentiated. Experimental blindfolded listening tests of segmented tubes and tubes according to embodiments of the present invention show that different tubing materials do contribute to the character of the sound and that these differences in tone are further articulated and differentiated with continuously curved resonators. Typical resonator tubes are made from brass, aluminum, steel or an alloy of copper, tin and lead. According to embodiments of the invention, the continuously curved tubes can be made from different materials to provide instruments with a wider variety of tonal qualities than previously could be obtained with instruments having soldered or welded tubes.

Figure 4C:
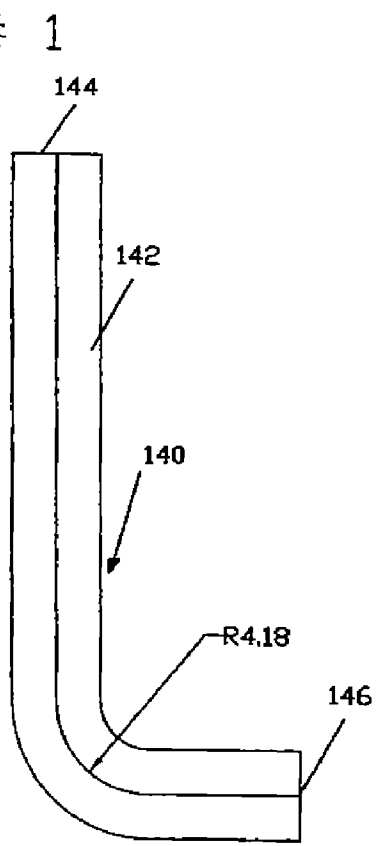
FIG. 4C is a side elevational view of a U-shaped resonator according to an embodiment of the invention.
Figure 4B:
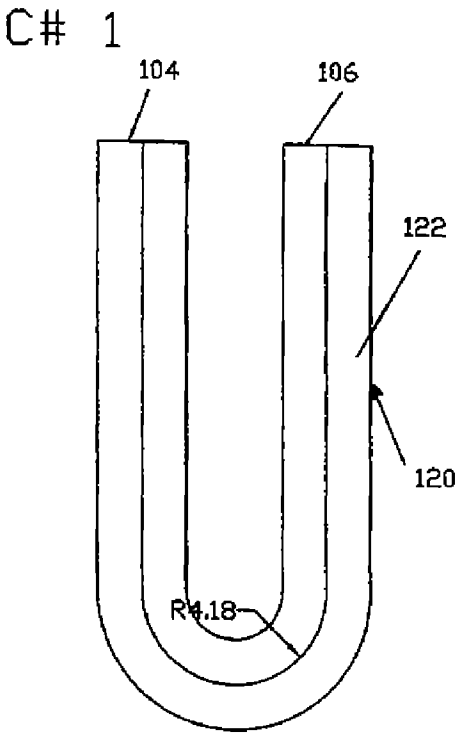
FIG. 4B is a side elevational view of a J-shaped resonator according to an embodiment of the invention.
Figure 4A:
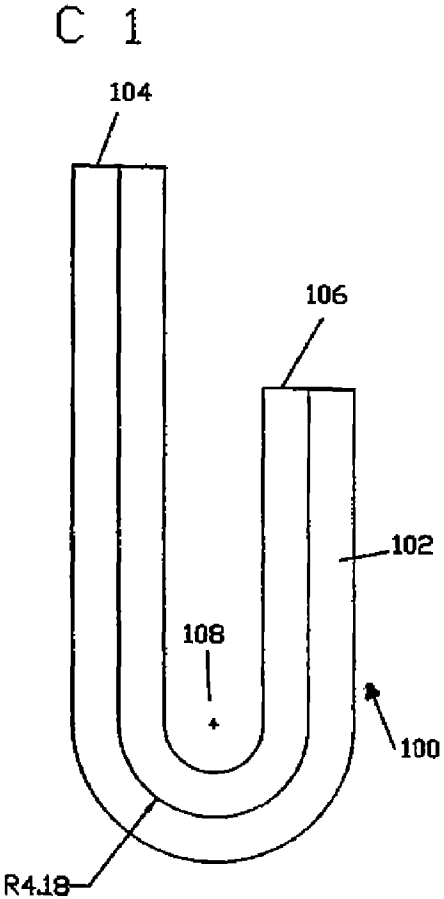
FIG. 4A is a side elevational view of an L-shaped resonator according to an embodiment of the invention.

Referring now to FIGS. 4A-4C, resonator tubes according to embodiments of the invention are shown. In FIG. 4A, a first octave C resonator 100 is shown, which is substantially J-shaped. The resonator 100 comprises a substantially continuous conduit, which is shown as being a cylindrical tube. The resonator 100 has a pair of open ends 104, 106 and a bend radius indicated by R in FIG. 4A, which is taken from center point to the center of the tube. In an exemplary embodiment, the tube diameter is approximately four inches, and the bend radius is substantially equal to the tube diameter. In the embodiment shown, the bend radius is 4.18. It will be appreciated of course, that the invention is not limited to a particular tube diameter or bend radius.

As used herein, "substantially continuous" means a curved conduit that includes curved bends and a smooth transition between sections in embodiments in which the resonator is made from more than one section. "Substantially continuous" is distinguished from prior art resonators that are made from a plurality of straight sections that result in a U-shaped or J-shaped tube that has relatively sharp angles between the sections. Thus, a substantially continuous tube is one that comprises a single section or more than one section joined together so that there are no angles or distinguishable boundaries between sections.

FIG. 4B shows a first octave C sharp resonator 120 comprising a continuous tubular conduit bent into a substantially U-shape. The resonator includes two open ends 104 and 106. It will be appreciated that one of the ends 104, 106 would likely be plugged when mounted on an instrument. FIG. 4C shows a substantially L-shaped F sharp resonator 140 comprising a tubular conduit 142 and having open ends 144 and 146. The embodiments shown in FIGS. 4A-4C each comprise unitary sections with no joints. According to other embodiments of the invention, particularly for U-shaped and J-shaped resonators, the U-shaped and J-shaped resonators can be formed by joining together two sections. For example, such resonators could be provided by coupling together two L-shaped sections. Smoother joints are provided by joining the sections using a welding or soldering technique that does not add material to the weld or solder joint. For example, tungsten inert gas welding provides a smooth joint. According to one or more embodiments of the invention, the U-shaped or L-shaped resonators comprise less than two joints.

Figures 3A, 3B, 3C:
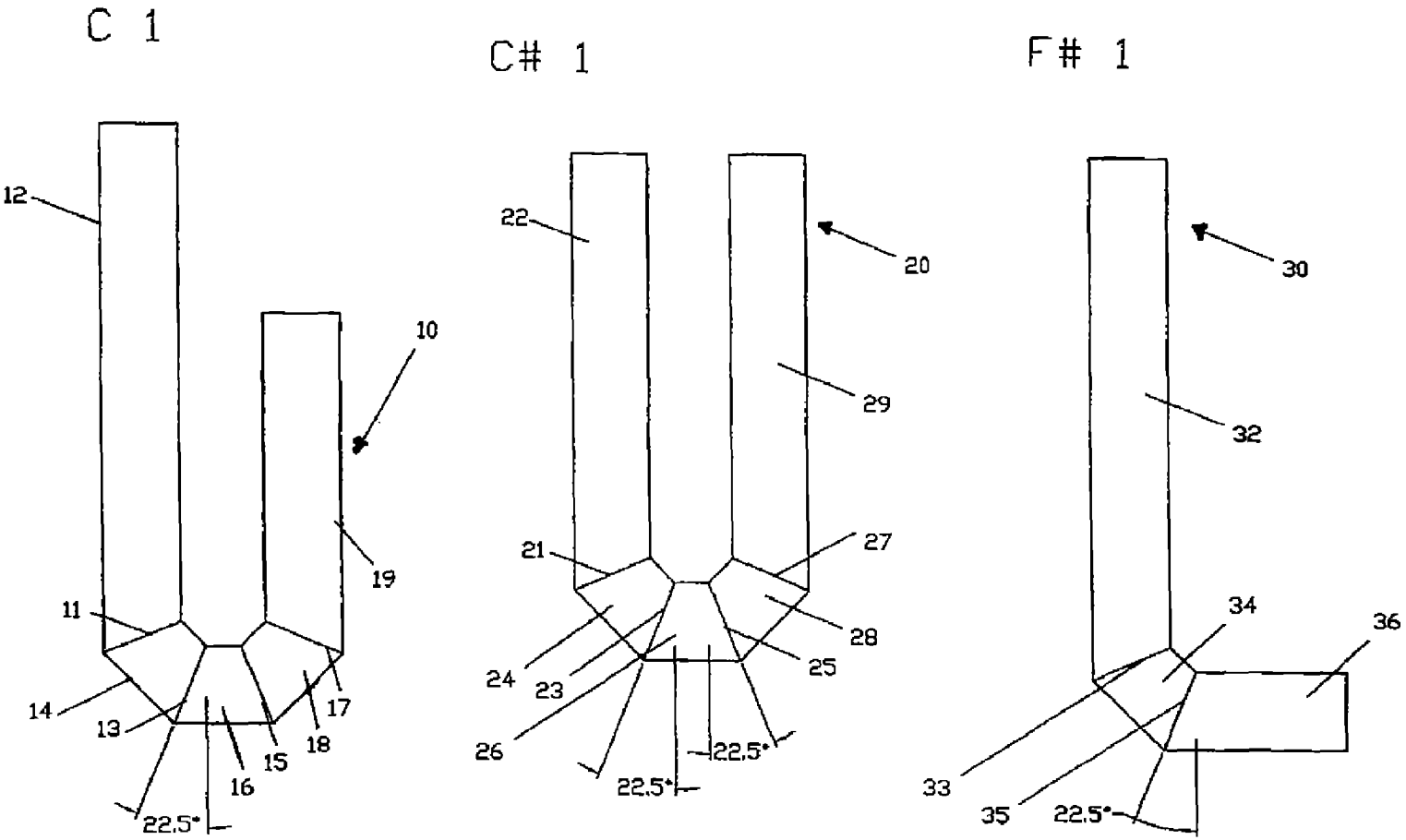
FIG 3A (PRIOR ART)
FIG 3B (PRIOR ART)
FIG 3C (PRIOR ART)
FIG. 3A is a side elevational view of yet another type of prior art resonator.
FIG. 3B is a side elevational view of another type of prior art resonator.
FIG. 3C is a side elevational view of another type of prior art resonator.
Figure 3D:
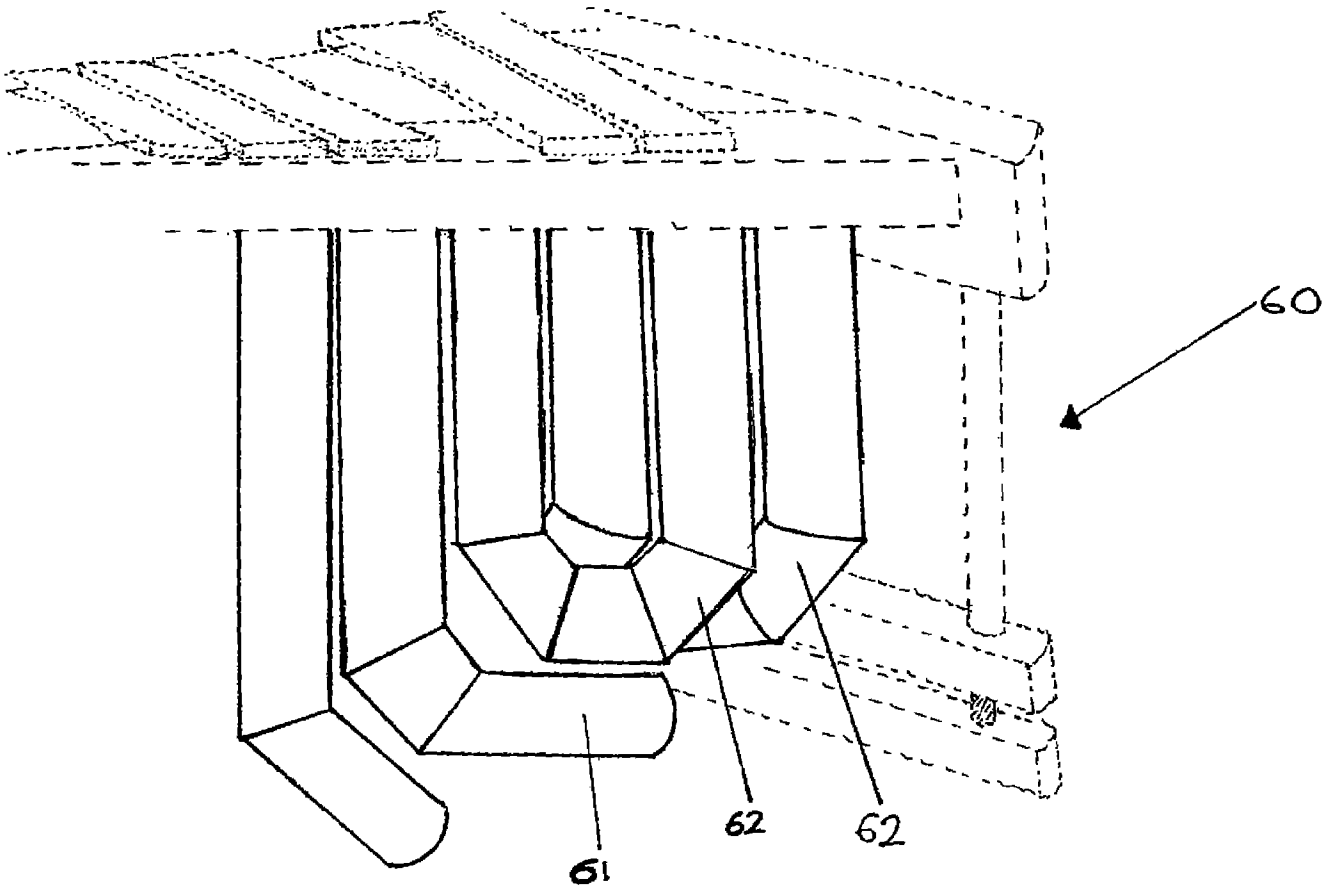
FIGURE 3D (PRIOR ART)
FIG. 3D is a perspective of the audience side of a prior art percussion keyboard instrument
Figure 5:
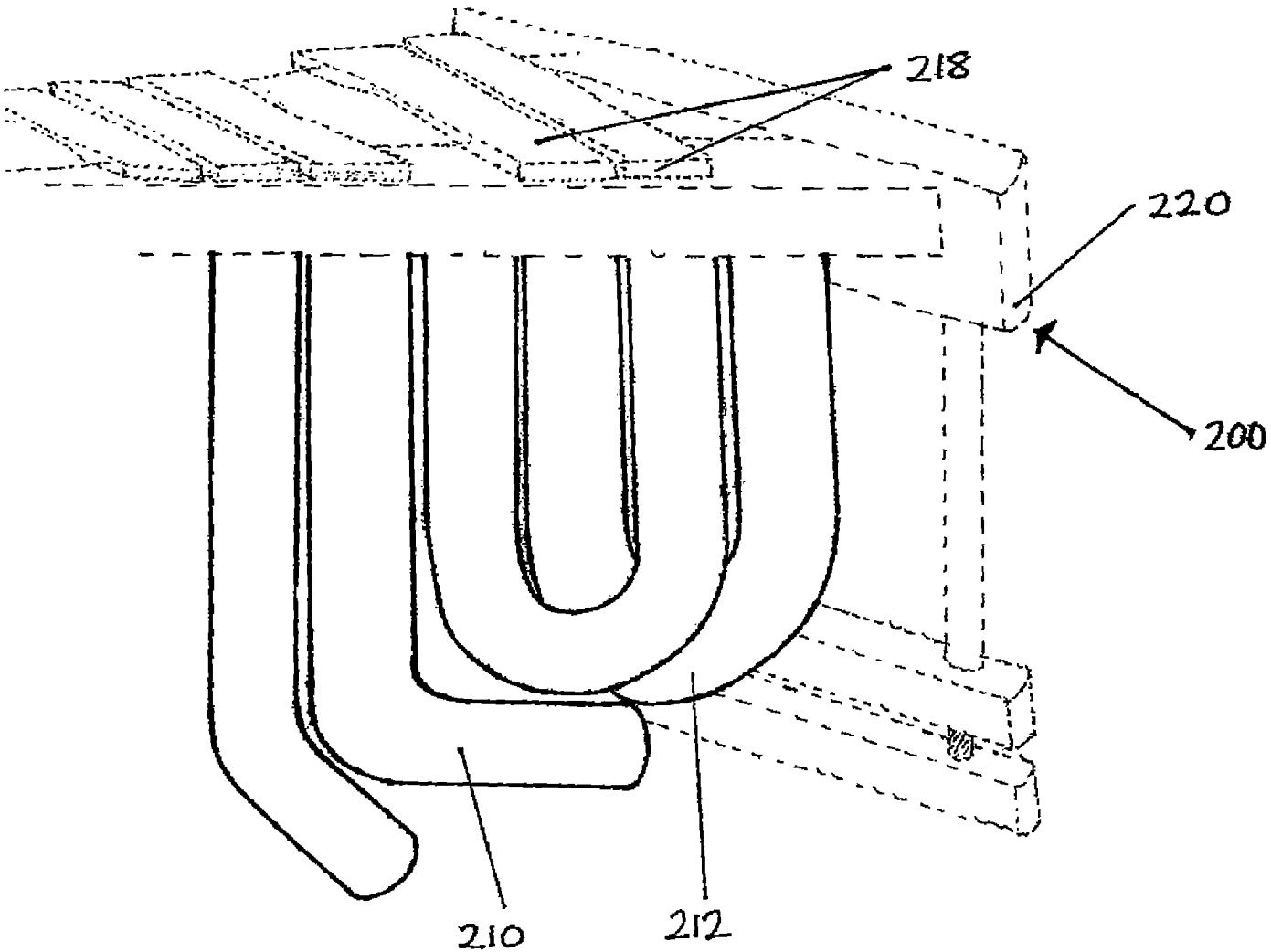
FIG. 5 is a partial perspective view of the audience side of a percussion keyboard instrument according to an embodiment of the invention.

Referring now to FIG. 5, a partial perspective view of the audience side showing the low octave of a keyboard percussion instrument 200 and including L-shaped resonators 210 and U-shaped resonators 212 according to an embodiment of the invention. The resonators 210, 212 are in proximity to tone bars 218 (shown in phantom), the entire instrument being mounted on a frame 220. As will be appreciated by the skilled artisan, the tone bars 218 and resonators are arranged so that a tone bar is acoustically coupled with an associated resonator so that the resonator reflects the pressure wave emitted by the bar thereby increasing volume of the instrument. Referring to FIG. 3D, which shows a partial perspective view of a prior art keyboard percussion instrument 60, the resonators 61, 62 have angled bends of the type shown in FIGS. 3A-3C. A comparison of the instrument shown in FIG. 5 and the instrument shown in FIG. 3D reveals that the instrument in FIG. 5 is more aesthetically appealing than the instrument shown in FIG. 3D. The lack of sharp bends and the smooth look of the resonators is more visually pleasing than the prior art instrument.

Figure 6:
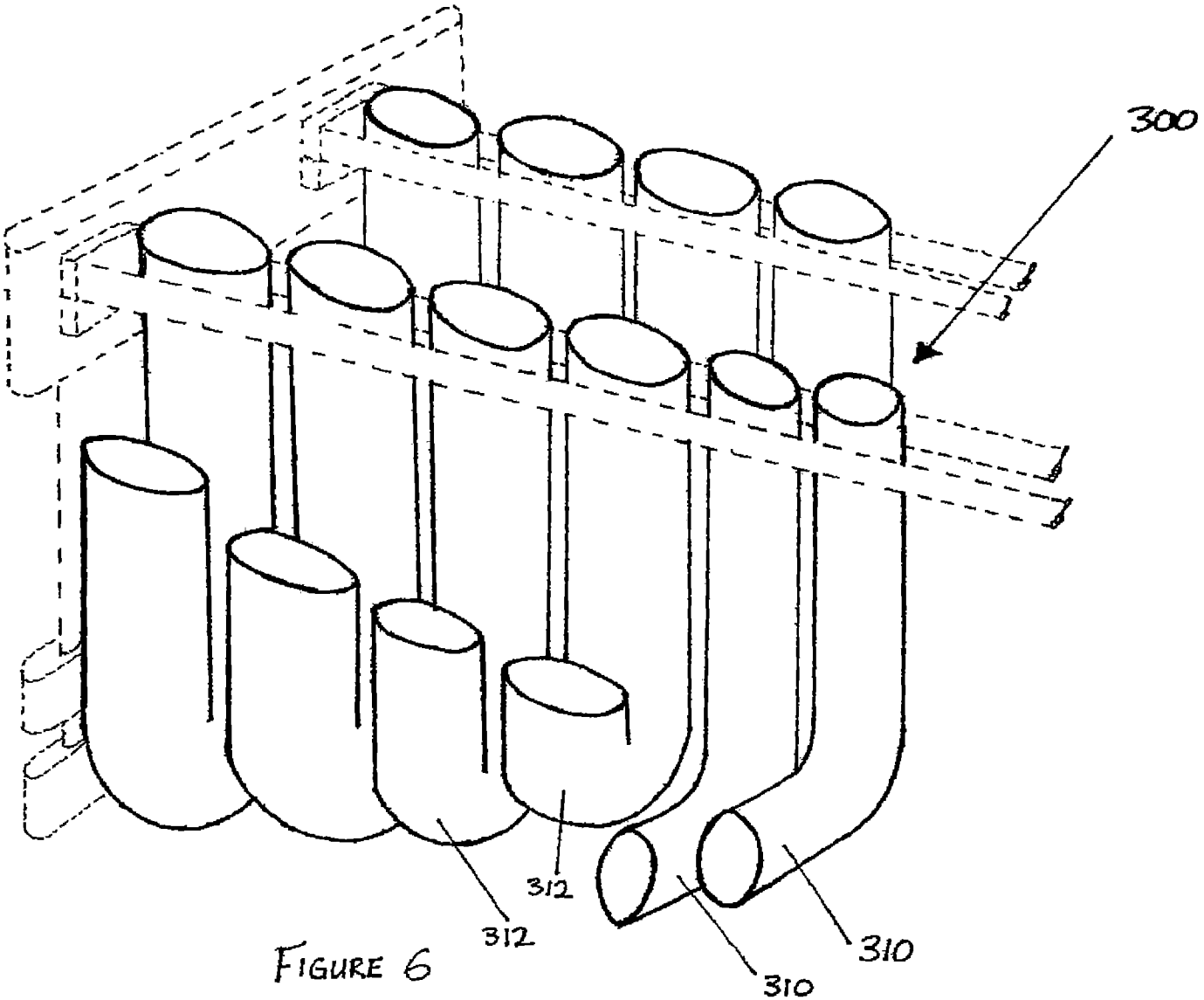
FIG. 6 is a disassembled partial perspective view of the player side of a percussion keyboard instrument showing the resonators according to an embodiment of the invention.

FIG. 6 shows a disassembled perspective view of the player side of a keyboard percussion instrument 300, showing L-shaped resonators 310 and J-shaped resonators 312. For clarity, the tone bars have been removed from the view shown in FIG. 6. The resonators 310, 312 are continuously curved conduits having no joints or sharp bends.

Figure 7:
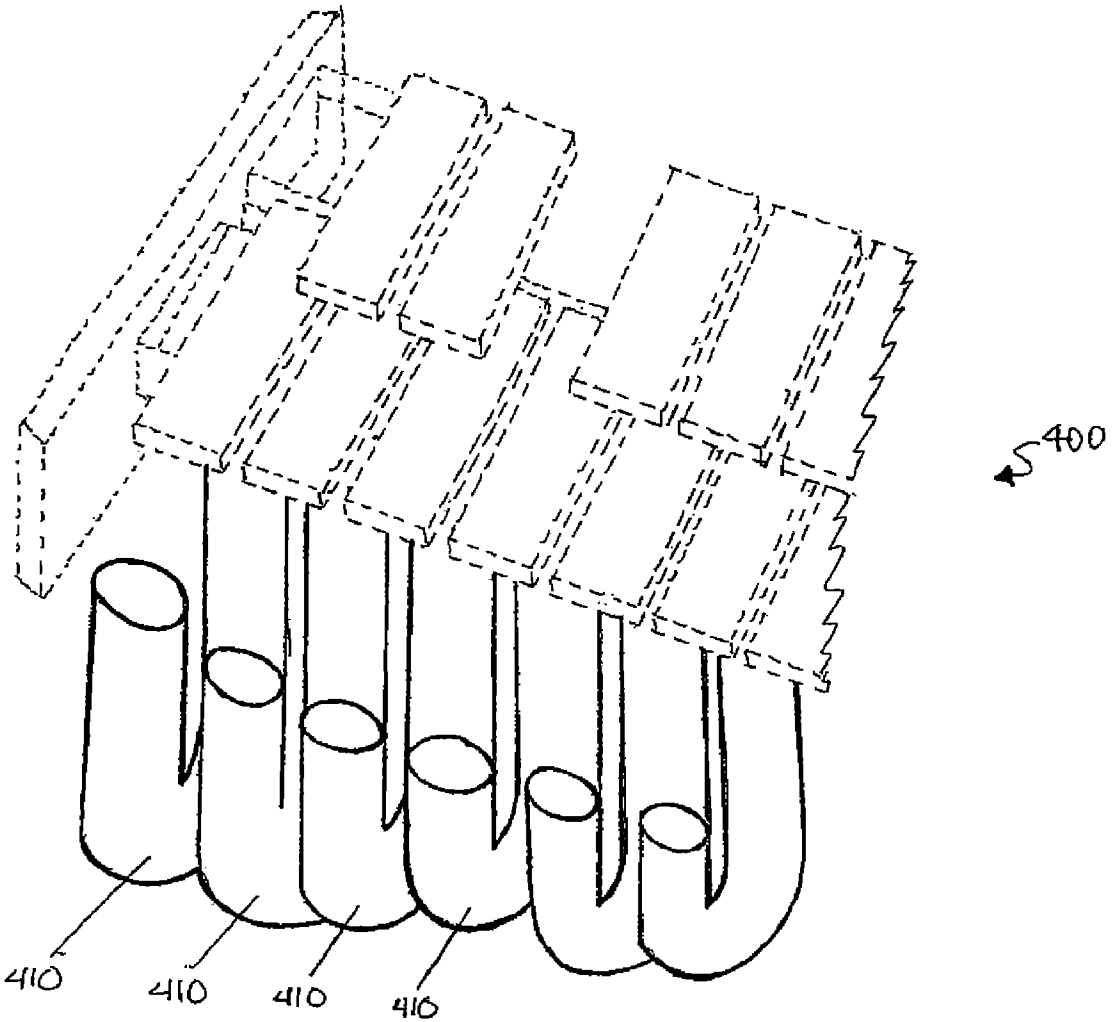
FIG. 7 is a partial perspective view of the player side of a percussion keyboard instrument according to an embodiment of the invention.

FIG. 7 shows a partial perspective view of the player side of a percussion keyboard instrument 400 according to another embodiment of the invention in which the resonators 410 are J-shaped.

Figure 8:
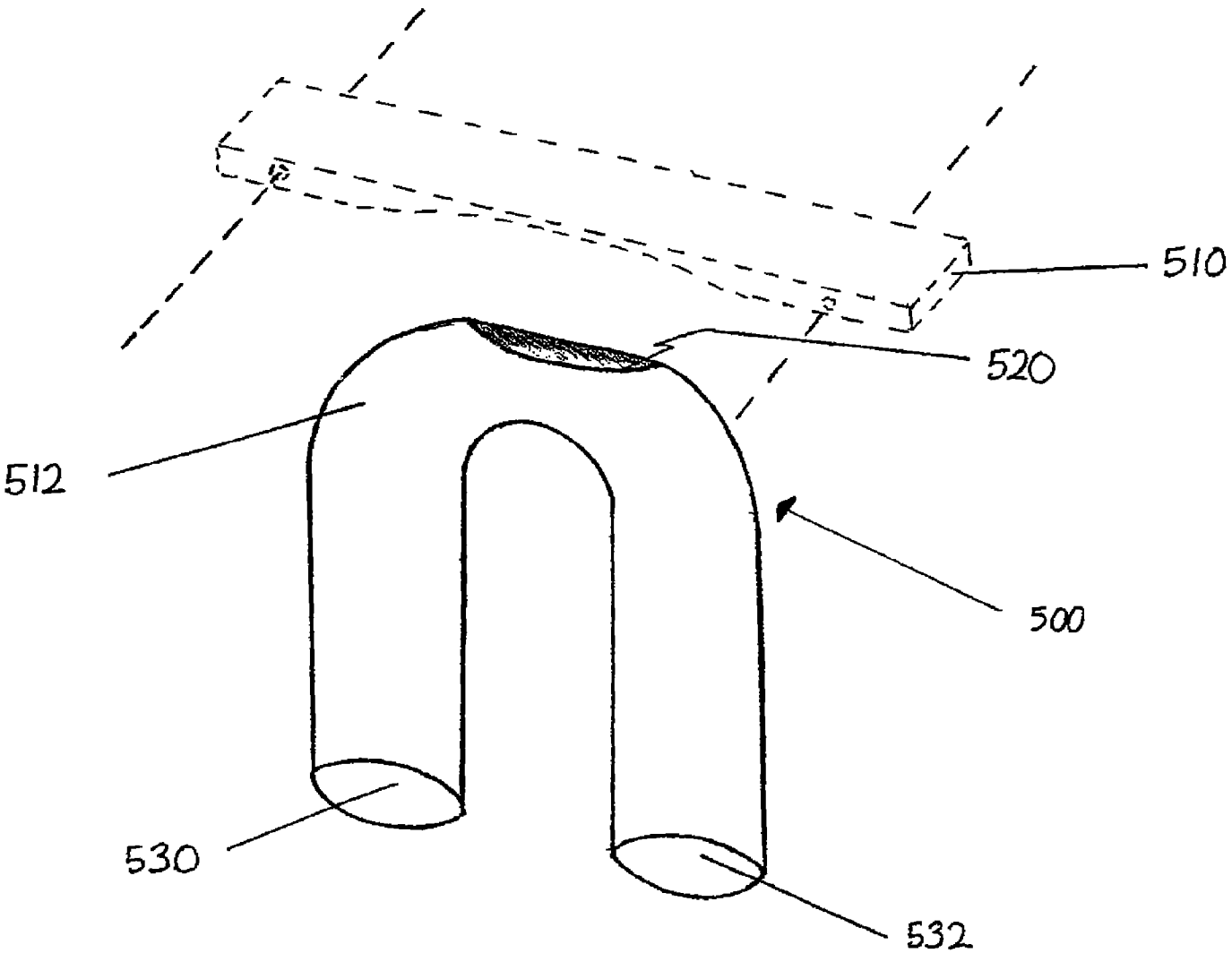
FIG. 8 is a perspective view of a percussion instrument resonator according to an alternative embodiment of the invention.

Referring now to FIG. 8, a resonator 500 and bar 510 are shown together. In the embodiment shown in FIG. 8, the resonator 500 is substantially U-shaped, and the U-shaped resonator is inverted such that the curved portion 512 is facing upwardly. The curved portion outer surface includes an aperture 520 through the curved surface. The resonator 510 further includes two open ends 530, 532, which would typically be plugged when mounted in a keyboard percussion instrument. The aperture 520 may be any suitable shape. In the embodiment shown, the aperture is shown as being elliptical in shape, however, the aperture 520 may be round, square or any other suitable shape.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments. The order of description of the above method should not be considered limiting, and methods may use the described operations out of order or with omissions or additions.

It is to be understood that the above description is intended to be illustrative, and not restrictive. Many other embodiments will be apparent to those of ordinary skill in the art upon reviewing the above description. The scope of the invention should, therefore, be determined with reference to the appended claims, along with the full scope of equivalents to which such claims are entitled.

The invention claimed is:

1. A keyboard percussion musical instrument comprising; a plurality of tone bars; and resonators in proximity to the tone bars, at least one of the resonators is a curved, substantially continuous conduit with no angles or distinguishable boundaries between sections, the conduit being curved along a longitudinal axis thereof and having an aperture proximate and acoustically coupled to a respective one of the tone bars.

2. The musical instrument of claim 1, wherein the resonator is curved to substantially resemble a J-shape or U-shape.

3. The musical instrument of claim 2, wherein the resonator tube includes only one joint.

4. The musical instrument of claim 2, wherein the resonator comprises a single, unitary section with no joints.

5. The musical instrument of claim 2, wherein the resonator is substantially tubular and defines a tube radius, and the tube is bent about a bend radius, the tube radius and the bend radius being substantially equal.

6. The musical instrument of claim 1, wherein the resonator is curved to substantially resemble an L-shape.

7. The musical instrument of claim 1, wherein the resonator has no internal encumbrances.

8. The musical instrument of claim 7, wherein the resonator is stopped on one end.

9. The musical instrument of claim 7, wherein the resonator is open on both ends.

10. The musical instrument of claim 1, wherein the resonator is constructed so that it resonates only its natural fundamental frequency and its natural overtones with no non-harmonic resonances from a struck tone bar associated with the resonator.

11. The musical instrument of claim 1, wherein the conduit includes at least one open end having the aperture proximate the respective one of the tone bars.

12. The musical instrument of claim 1, wherein the conduit has a rectangular cross section.

13. A keyboard percussion musical instrument comprising: a plurality of tone bars; and resonators acoustically coupled with the tone bars, wherein at least one of the resonators is a conduit constructed so that it resonates only its natural fundamental frequency and its natural overtones with no non-harmonic resonances from a struck tone bar associated with the resonator, the conduit being curved along a longitudinal axis thereof and having an aperture proximate and acoustically coupled to a respective one of the tone bars, and wherein the internal surface of the conduit is smooth and free from sharp bends, angles and discontinuities.

14. The musical instrument of claim 13, wherein the resonator comprises a conduit made from a substantially continuous piece of material and includes less than two joints.

15. The musical instrument of claim 14, wherein the resonator is substantially J-shaped, U-shaped or L-shaped.

16. The musical instrument of claim 14, wherein the resonator is L-shaped and comprises a unitary section with no joints no angles or distinguishable boundaries between sections.

17. The musical instrument of claim 14, wherein the resonator is J-shaped and comprises a unitary section with no joints.

18. The musical instrument of claim 14, wherein the resonator is J-shaped and comprises only two sections joined together.

19. The musical instrument of claim 14, wherein the resonator is U-shaped and comprises only two sections joined together.

20. The musical instrument of claim 14, wherein at least one of the resonators comprises an inverted U-shaped conduit having two downwardly facing open ends and an outer curved surface having the aperture through the outer curved surface.

21. The musical instrument of claim 20, wherein the downwardly open ends are plugged.

22. A keyboard percussion musical instrument comprising: a plurality of tone bars; and resonators in proximity to the tone bars, wherein at least one of the resonators is a curved, substantially continuous conduit including a single, unitary section with no joints, the conduit being curved along a longitudinal axis thereof and having an aperture proximate and acoustically coupled to a respective one of the tone bars.

23. The musical instrument of claim 1, wherein the conduit is an inverted U-shaped conduit having two downwardly facing open ends and an outer curved surface having the aperture through the outer curved surface.

* * * * *